US008328171B2

(12) United States Patent
Aaron

(10) Patent No.: US 8,328,171 B2
(45) Date of Patent: Dec. 11, 2012

(54) MULTI FUNCTION LINKAGE CLAMPING SYSTEM

(75) Inventor: Charles W. Aaron, Salado, TX (US)

(73) Assignee: Georgetown Rail Equipment Company, Georgetown, TX (US)

( * ) Notice: Subject to any disclaimer, the term of this patent is extended or adjusted under 35 U.S.C. 154(b) by 880 days.

(21) Appl. No.: 12/466,917

(22) Filed: May 15, 2009

(65) Prior Publication Data

US 2009/0269177 A1 Oct. 29, 2009

Related U.S. Application Data

(63) Continuation-in-part of application No. 11/472,952, filed on Jun. 22, 2006, now abandoned.

(51) Int. Cl.
*B23Q 3/08* (2006.01)

(52) U.S. Cl. ..... 269/32; 414/333; 414/339; 414/560

(58) Field of Classification Search ..... 269/32, 269/24; 414/333, 339, 560
See application file for complete search history.

(56) References Cited

U.S. PATENT DOCUMENTS

| | | | | |
|---|---|---|---|---|
| 1,865,519 | A | 7/1932 | Hoffer | |
| 1,948,799 | A | 2/1934 | Oyster | |
| 2,984,176 | A | 5/1961 | Sommer | |
| 3,204,947 | A | 9/1965 | Sendoykas | |
| 3,371,925 | A | 3/1968 | Blatt | |
| 3,545,050 | A | 12/1970 | Blatt | |
| 4,576,367 | A | 3/1986 | Horn | |
| 5,193,789 | A | 3/1993 | Tucker | |
| 5,722,810 | A | 3/1998 | Young | |
| 6,059,277 | A * | 5/2000 | Sawdon et al. | 269/24 |
| 6,315,515 | B1 | 11/2001 | Young | |
| 6,386,598 | B1 | 5/2002 | Dykstra | |

* cited by examiner

*Primary Examiner* — Lee D Wilson
*Assistant Examiner* — Jamal Daniel
(74) *Attorney, Agent, or Firm* — Parsons Behle & Latimer

(57) ABSTRACT

A linkage clamping system that may be used both for moving a clamp laterally and for rotating the clamp. The device includes a linear actuator, a rotational linkage assembly, and a clamping member. The linear actuator may first rotate the clamp, then move the clamp laterally, or may be configured to move the clamp laterally first, then rotate it. Both the lateral and rotational movements are achieved in distinct motions with a single linear actuator. The clamp may be rotated about 180 degrees and the lateral movement may only be limited by the lateral movement provided by the linear actuator. The linkage clamping system may be used to secure equipment, such as a material handler for unloading an open top railroad car.

27 Claims, 10 Drawing Sheets

MULTI FUNCTION LINKAGE CLAMPING SYSTEM

CROSS REFERENCE TO RELATED APPLICATIONS

This application is a continuation-in-part application of U.S. patent application Ser. No. 11/472,952, filed Jun. 22, 2006 now abandoned entitled "Gondola Car Material Handler," which is incorporated herein in its entirety by reference.

BACKGROUND

1. Field of the Invention

The present application relates generally to clamping means that may be used with a mobile apparatus that may need to be secured to the travelling surface upon which it sets, such as a material handler travelling upon an open top railroad car.

2. Description of the Related Art

Many clamping means are known and are in use today. Some clamping means pivot about a fixed axis to clamp one member to another. Other clamping means move laterally to clamp one member to another. Typically, one actuation means is needed for lateral movement and another actuation means is needed for rotational movement. However, some clamping means have incorporated complex linkage systems to provide a limited amount of reach with simultaneous rotation. This reach/rotate motion has an advantage in the ability to be actuated with a single actuator, but the lateral and rotational motions cannot be performed separately and are further constrained by the design of the linkage system.

In light of the forgoing, it would be beneficial to provide a clamping system that can rotate and move laterally in distinct motions.

Clamping means that are used with a mobile apparatus are also known. For example, U.S. patent application Ser. No. 11/472,952 discloses a clamping means which is designed to clamp a material handler to the sides of an open top railroad car. The clamping means disclosed uses a dedicated power unit, such as, for example, a hydraulic piston or an electric motor, to rotate the clamping means and another power unit that may be used to vary the lateral extension of the clamping means. The mobile apparatus may comprise four sets of clamping means with two power units each, for a total of eight power units for rotating the clamping means and moving it laterally.

The use of two power units per clamping means to perform two separate tasks is substantially more expensive than use of a single power unit to perform the two tasks. Also, the two power units must be connected to the clamping means by a greater amount of hardware than a single means. Additionally, the necessity of a control means capable of actuating all of the power units individually further increases the cost. For example, in the case of a hydraulic power unit, the apparatus may have a limited number of ports on the hydraulic swivel used to control the power units, with additional ports adding addition cost.

In light of the forgoing, it would be beneficial to provide a clamping system that can move laterally to a distance that is independent of the number of degrees the clamping system can rotate.

It would also be beneficial to provide a clamping system that can move laterally for a distance that is about equal to the ability of the actuator.

It would also be beneficial to provide a clamping system that can be used with a single power unit.

The present disclosure is directed toward overcoming, or at least reducing the effects of one or more of the issues set forth above.

SUMMARY

One embodiment of the invention is a linkage clamping system comprising a clamping member, a linear actuator capable of linear movement, and a rotational linkage assembly. A first portion of the rotational linkage assembly may be connected to the clamping member and a second portion of the rotation linkage assembly may be connected to the linear actuator. The rotational linkage assembly may be adapted such that rotational movement of a portion of the rotational linkage assembly rotates the clamping member and such that lateral movement of the rotational linkage assembly laterally moves the clamping member. Linear movement of the linear actuator may both rotate and laterally move the rotational linkage assembly. The lateral movement and rotation may be distinct movements.

The linkage clamping system may be configured such that linear movement of the linear actuator first rotates a portion of the rotational linkage assembly and then laterally moves the rotational linkage assembly. The linkage clamping system may alternatively be configured such that linear movement of the linear actuator first laterally moves the rotational linkage assembly and then rotates a portion of the rotational linkage assembly. The rotational linkage assembly may be configured to bind after a number of degrees of rotation in a first direction, which may stop the rotation in the first direction. The rotational linkage assembly may be configured to unbind if rotated in the direction opposite of the first direction. The clamping member may be configured to connect the linkage clamping system to a portion of an open top rail car. The linkage clamping system may be configured to allow the clamping member to rotate at least about 45 degrees. The linkage clamping system may be configured to allow the clamping member to be moved laterally at least about 1 inch. The linkage clamping system may be configured to be used with a material handler. The linear actuator may comprise a hydraulic power unit, an electric power unit, or a pneumatic power unit. The rotational linkage assembly may comprise at least one clamp linkage which may be connected to the clamping member, at least one actuator linkage which may be rotatably connected to the linear actuator, and at least one connecting linkage which may be rotatably connected to the at least one clamp linkage and rotatably connected to the at least one actuator linkage.

The rotational linkage assembly may comprise a set of two clamp linkages connected to the clamping member, a set of two actuator linkages connected to the linear actuator, and a connecting linkage. The connecting linkage may be rotatably connected to the set of two clamp linkages and rotatably connected to the set of two actuator linkages. The linear actuator may comprise an actuator connector connected to a shaft. The shaft may be slidably connected to an actuator body, and the second set of two linkages may be rotatably connected to the linear actuator at the actuator connector. The linkage clamping system may further comprise a mounting plate. At least one of the linkages may be rotatably connected to the mounting plate. The linkage clamping system may further comprise a pinup plate, which may be connected to the clamping member. The pinup plate may be configured be able to prevent rotation of the clamping member.

Another embodiment of the invention is a rotational linkage assembly comprising at least one clamp linkage, which may have a first mating surface. A portion of the at least one clamp linkage may be configured to be connected to a clamping member. The rotational linkage assembly includes at least one actuator linkage that may have a second mating surface that corresponds to the mating surface of the at least one clamp linkage. A portion of the actuator linkage may be configured to be rotatably connected to a linear actuator. The rotational linkage assembly includes a connecting linkage rotatably connected to the at least one actuator linkage and rotatably connected to the at least one clamp linkage. A mounting plate may be rotatably connected to the at least one linkage. The first mating surface and the second mating surface may be configured to meet and bind after the linkages are rotated a number of degrees in a first direction. The first mating surface and the second mating surface may be configured to unbind if the linkages are rotated in a direction opposite of the first direction.

The at least one actuator linkage may further comprise at least one planar portion. The planar portion may be configured to mate with a plate after the linkages are rotated a number of degrees in a second direction. The planar portion and the plate may oppose further rotation of the linkages in the second direction. The clamp linkage may be generally curved and the actuator linkage may be generally L-shaped. The connecting linkage may be generally straight. The mating surface of the at least one clamp linkage may be at one end of the clamp linkage and the mating surface of the actuator linkage may be at about the middle of the linkage. The rotational linkage assembly may comprise two clamp linkages. At least a portion of the clamp linkages may be separated by a clamp linkage separator. The rotational linkage assembly may comprise two actuator linkages. At least a portion of the actuator linkages may be separated by an actuator linkage separator. The connecting linkage may separate at least a portion of the clamp linkages. The connecting linkage may separate at least a portion of the actuator linkages.

One embodiment is a method for clamping comprising actuating a linear actuator to move linearly, rotating a clamping member, and moving the clamping member laterally. The rotation of the clamping member and the lateral movement of the clamping member may be distinct motions. Linear movement of the linear actuator may rotate the clamping member and may laterally move the clamping member. Rotating the clamping member may be achieved through the actuation of a rotational linkage assembly by the linear actuator. A wheel may be moved laterally simultaneously while moving the clamping member.

One embodiment is a mobile apparatus comprising a wheel mount connected to a mobile apparatus. The wheel mount may comprise at least one wheel and the lateral distance from the wheel to the mobile apparatus may be adjustable. The mobile apparatus may further comprise a linkage clamping system. The linkage clamping including a linear actuator connected to the wheel mount, a rotational linkage assembly connected to the linear actuator, and a clamping member connected to the rotational linkage assembly. The clamping member may be configured to be moved laterally by the linear actuator. The clamping member may be configured to be rotated with rotation of the rotational linkage assembly. Rotation of the rotational linkage assembly may be actuated by linear movement of the linear actuator. Lateral movement of the clamping member and rotation of the clamping member may be distinct motions.

The lateral distance between the wheel and the mobile apparatus may be configured to be adjusted by the linear actuator simultaneously with the lateral movement of the clamping member. The mobile apparatus may further comprise a plurality of linkage clamping systems. The clamping member may be configured to secure at least a portion of the mobile apparatus to an open top railroad car. The rotational linkage assembly may comprise a plurality of linkages. The plurality of linkages may comprise at least one set of mating surfaces. The mating surfaces may be configured to bind at a number of degrees of rotation. Binding may limit rotation of the clamping member in at least one direction. The mating surfaces may be configured to unbind with rotation in the opposite direction.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
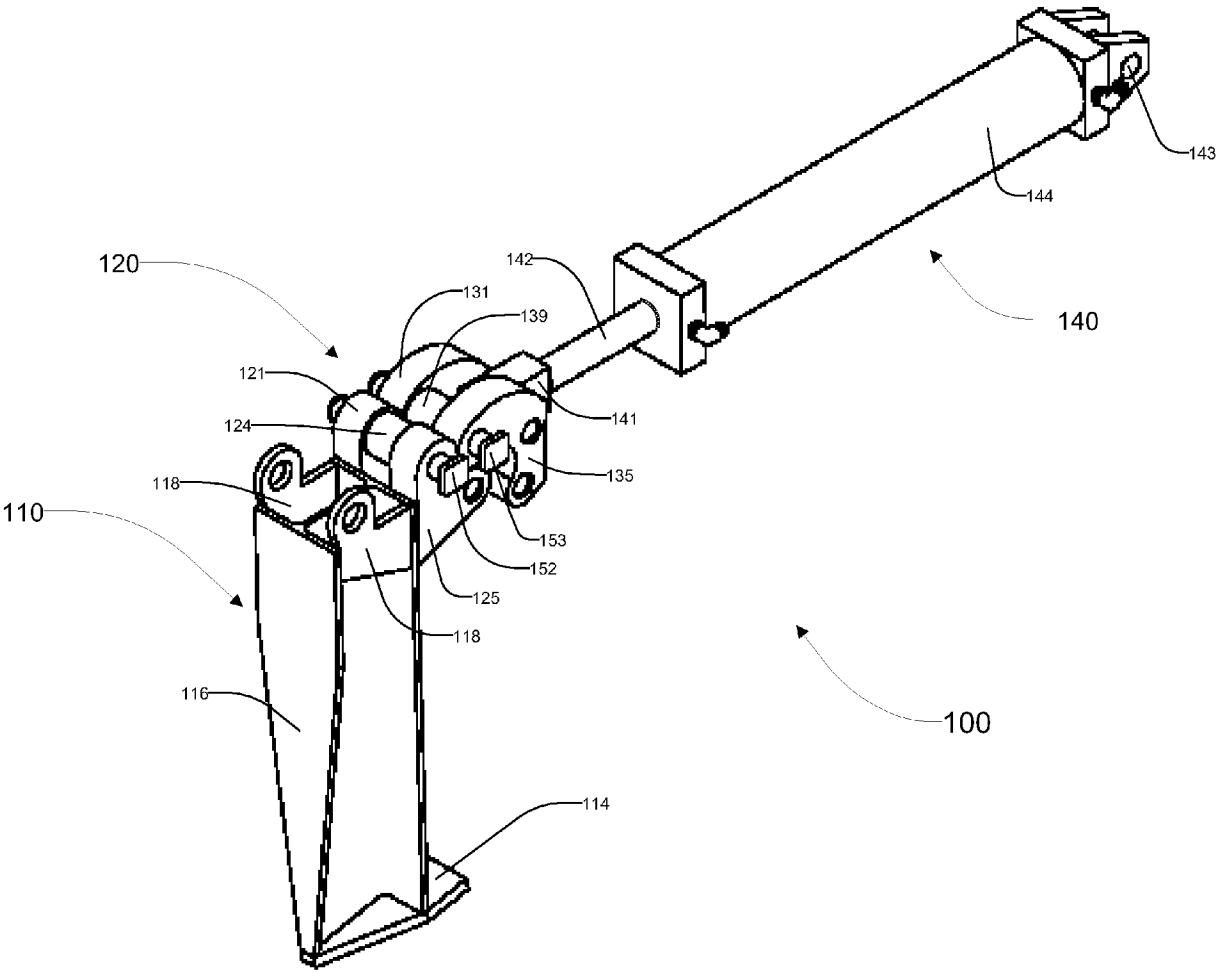
FIG. 1 is a perspective view of an embodiment of a linkage clamping system.
Figure 2:
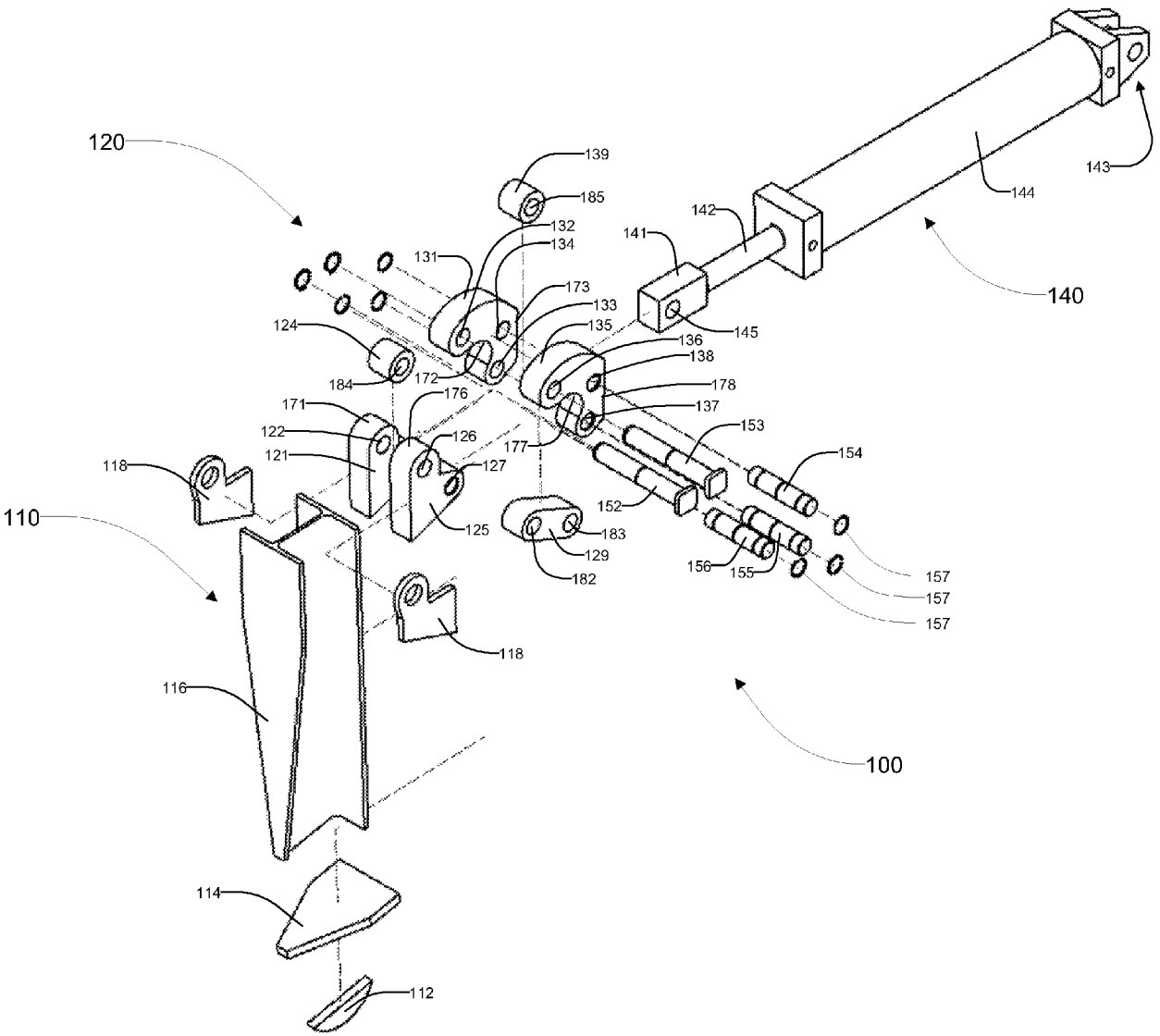
FIG. 2 is an exploded, perspective view of the embodiment of the linkage clamping system of FIG. 1.

FIG. 1 is a perspective view and FIG. 2 is an exploded perspective view of an embodiment of a linkage clamping system 100. As shown in FIG. 1, the linkage clamping system 100 comprises a clamping member 110 connected to a rotational linkage assembly 120. The rotational linkage assembly 120 is further connected to a linear actuator 140, such that the rotational linkage assembly 120 is actuated by lateral movement from the linear actuator 140.

The linkage clamping system 100 is able to provide both rotation of a clamping member 110 and lateral movement of the clamping member 110 with the same power unit, the linear actuator 140. In the embodiment shown in FIG. 1, lateral movement from the linear actuator 140 may first rotate the clamping member 110, then move the clamping member 110 laterally. For example, lateral movement by the linear actuator 140 may actuate the rotational linkage assembly 120, which has a rotational arc of a set number of degrees. The range of the rotational arc may be set by one or more stops. Actuation of the rotational linkage assembly 120 provides rotational motion to the clamping member 110. The clamping member 110 may rotate a set number of degrees, such as, for example, about 45 degrees, about 90 degrees, about 180 degrees, about 200 degrees, or another suitable number of degrees, before stopping. When the clamping member has been fully rotated, the linear actuator may continue to move laterally, which moves the clamping member 110 laterally.

To rotate the clamping member 110 before laterally moving the clamping member 110, rotation must be easier to achieve than lateral movement. For example, the resistance to rotation of the clamping member 110 may be less that the resistance to lateral movement. In another example, the clamping member 110 may be secured to prevent rotation. Rotation and lateral movement will be discussed in greater detail later in the specification.

FIG. 2 is an exploded perspective view of the linkage clamping system 100 shown in FIG. 1. One embodiment of the clamping member 110 of the linkage clamping system 100 may comprise a clamp beam 116 with a clamp plate 114 and clamp reinforcement 112 at one end and one or more pin up plates 118 at the other end, as shown in FIG. 2. The clamping member 110 may be connected to the rotational linkage assembly 120, such as, for example, by welding the clamp beam to a portion of the rotational linkage assembly or by other suitable means. Other embodiments of a clamping member 110, such as a monolithic clamping member 110 or a differently shaped clamping member 110, would be apparent to one of ordinary skill in the art given the benefit of this disclosure.

As illustrated by FIG. 2, one embodiment of the linear actuator 140 comprises an actuator connector 141, with an opening 145, connected to a shaft 142 that moves within an actuator body 144. The linear actuator 140 further comprises a connecting means 143 connected to the actuator body 144 that may be used to connect the actuator 140 to equipment, such as, for example, a material handler 200 (shown in FIG. 8). The linear actuator 140 may use electricity, hydraulics, pneumatics, mechanics, or another suitable force generator to move the shaft 142 laterally. Other embodiments of a linear actuator 140, such as an embodiment with alternative connectors or force generating means, would be apparent to one of ordinary skill in the art given the benefit of this disclosure.

Figure 3B:
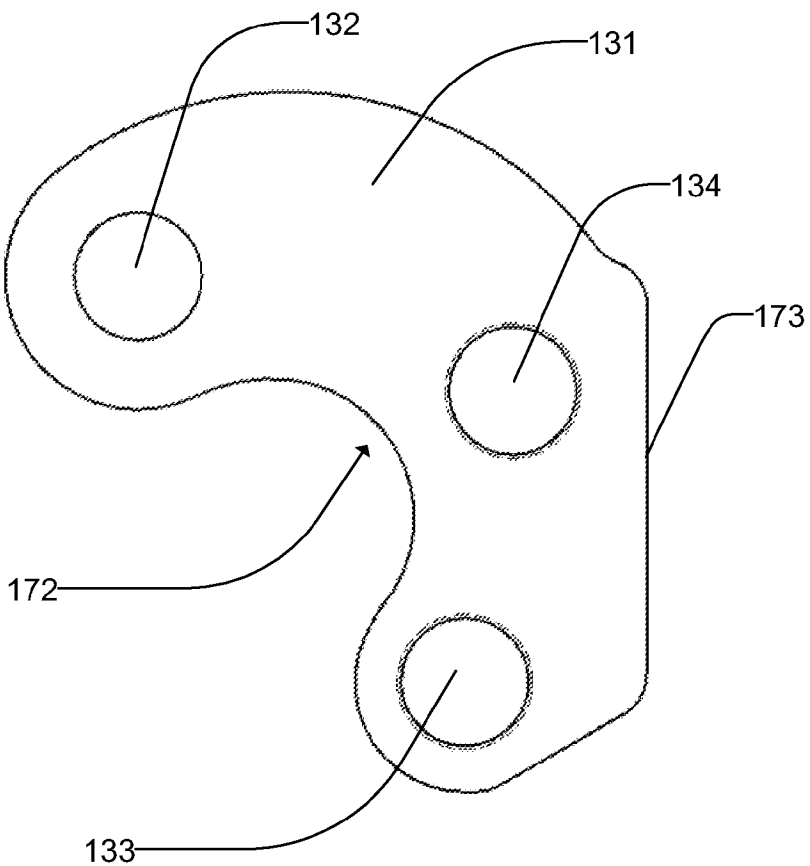
FIG. 3B is a side view of an actuator linkage.
Figure 3A:
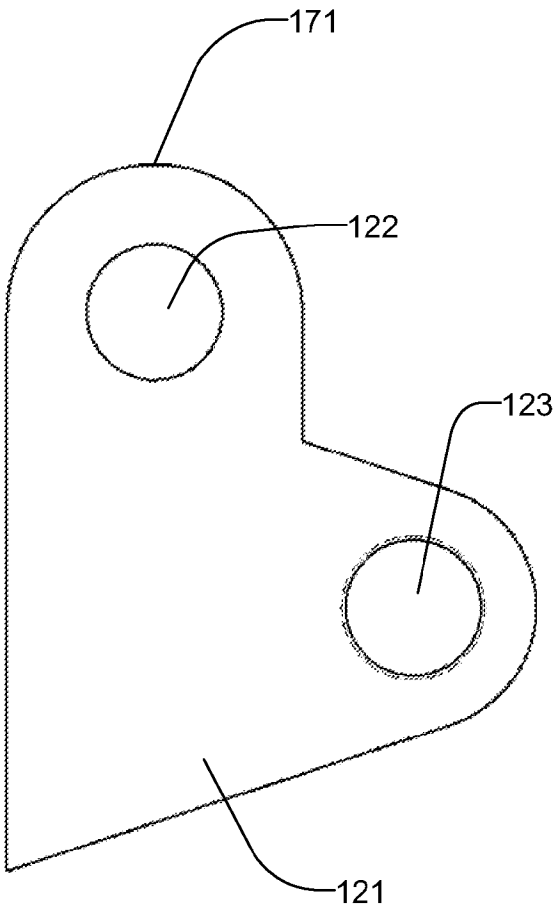
FIG. 3A is a side view of a clamp linkage.

Referring again to FIG. 2, one embodiment of the rotational linkage assembly 120 of the linkage clamping system 100 comprises a clamp linkage set 190 (best shown in FIG. 4), such as a left clamp linkage 121 and a right clamp linkage 125. As best shown in FIG. 3A, the left clamp linkage 121 has a first opening 122 near one end and a second opening 123 near another end, and is generally L-shaped. A portion of the left clamp linkage 121 may connect to the clamping member 110. The left clamp linkage 121 further comprises a left clamp mating surface 171 that will be further described subsequently. The right clamp linkage 125 mirrors the left clamp linkage 121, having a first opening 126 and a second opening 127, being generally L-shaped, having a right clamp mating surface 176, and having a portion that may be connected to the clamping member 110. Other embodiments of a clamp linkage set 190, such as a clamp linkage set 190 with a differing number of members or a clamp linkage set 190 of a differing shape or with differing mating surfaces, would be apparent to one of ordinary skill in the art, given the benefit of this current disclosure.

In the embodiment shown in FIG. 2, the linkages 121, 125 of the clamp linkage set 190 are separated by a clamp linkage spacer 124. The clamp linkage spacer 124 is cylindrical, but may be another suitable shape, and has an opening 184 that is substantially the same as the first openings 122, 126 of the left and right clamp linkages 121, 125.

The embodiment of the rotational linkage assembly 120 shown in FIG. 2 further comprises an actuator linkage set 191 (best shown in FIG. 4), such as a left actuator linkage 131 and a right actuator linkage 135. As best shown in FIG. 3B, the left actuator linkage 131 is generally curved in shape, and has a first opening 132 near one end, a second opening 133 near another end, and a third opening 134 at about the middle. The left actuator linkage 131 further comprises a left actuator mating surface 172 that is substantially complementary to the left clamp mating surface 171 of the left clamp linkage 121. Additionally, the left actuator linkage 131 comprises a planar portion 173 that may complement another portion, such as a plate, when the linkage clamping system 100 is used with equipment, such as a material handler 200 (shown in FIG. 8). The right actuator linkage 135 mirrors the left actuator linkage 131, being generally curved, with a first opening 136 near one end, a second opening 137 near another end, a third opening 138 at about the middle, having a right actuator mating surface 177 that is substantially complementary to the right clamp mating surface 176 of the right clamp linkage 125, and having a planar portion 178. Other embodiments, such as an actuator linkage set 191 with a differing number of members or an actuator linkage set 191 of a different shape or with a different mating surface, would be apparent to one of ordinary skill in the art, given the benefit of this disclosure.

In the embodiment illustrated by FIG. 2, the linkages 131, 135 of the actuator linkage set 191 are separated by an actuator linkage spacer 139. The actuator linkage spacer 139 is cylindrical, but may be another suitable shape, and has an opening 185 that is substantially the same as the first openings 132, 136 of the left and right actuator linkages 131, 135.

As shown in FIG. 2, the clamp linkage set 190 is connected to the actuator linkage set 191 through a connecting linkage 129. The connecting linkage 129 is generally straight, but may be another suitable shape, and has an opening at each end. A first opening 182 may be substantially similar to the second openings 123, 127 of the left and right clamp linkages 121, 125. A second opening 183 may be substantially similar to the second openings 133, 137 of the left and right actuator linkages 131, 135.

In the embodiment of the rotational linkage assembly 120 shown in FIG. 1 and FIG. 2, the left and right clamp linkages 121, 125, are rotatably connected to the clamp linkage spacer 124 with a clamp linkage through pin 152, which is inserted through the first openings 122, 126 and the opening 184 of the clamp linkage spacer 124. The left and right clamp linkages 121, 125 are further rotatably connected to the connecting linkage 129 with an internal pin 156, which is inserted though the second openings 123, 127 and the first opening 182 of the connecting linkage 129. The left and right clamp linkages 121, 125 may have outer retaining ring profiles (not shown) to capture the clamp linkage through pin 152 and/or the internal pin 156 via a capturing means, such as, for example, retaining rings 157.

The left and right actuator linkages 131, 135 are rotatably connected to the actuator linkage spacer 139 with an actuator linkage through pin 153, which is inserted through the first openings 132, 136 and the opening 185 of the clamp linkage spacer 139. The left and right actuator linkages 131, 135 are further rotatably connected to the connecting linkage 129 with an internal pin 155, which is inserted through the second openings 133, 137 and the second opening 183 of the connecting linkage 129. Additionally, the left and right actuator linkages 131, 135 are connected to the actuator connector 141 with an internal pin 154, which is inserted through the third openings 134, 138 and though the opening 145. The left and right actuator linkages 131, 135 may have outer retaining ring profiles (not shown) to capture connecting pins, such as the clamp linkage through pin 153 and the internal pins 154 and 155, using a capturing means, such as, for example, retaining rings 157. Other rotational connectors and connector capturing means would be apparent to one of ordinary skill in the art given the benefit of this disclosure.

Figure 4:
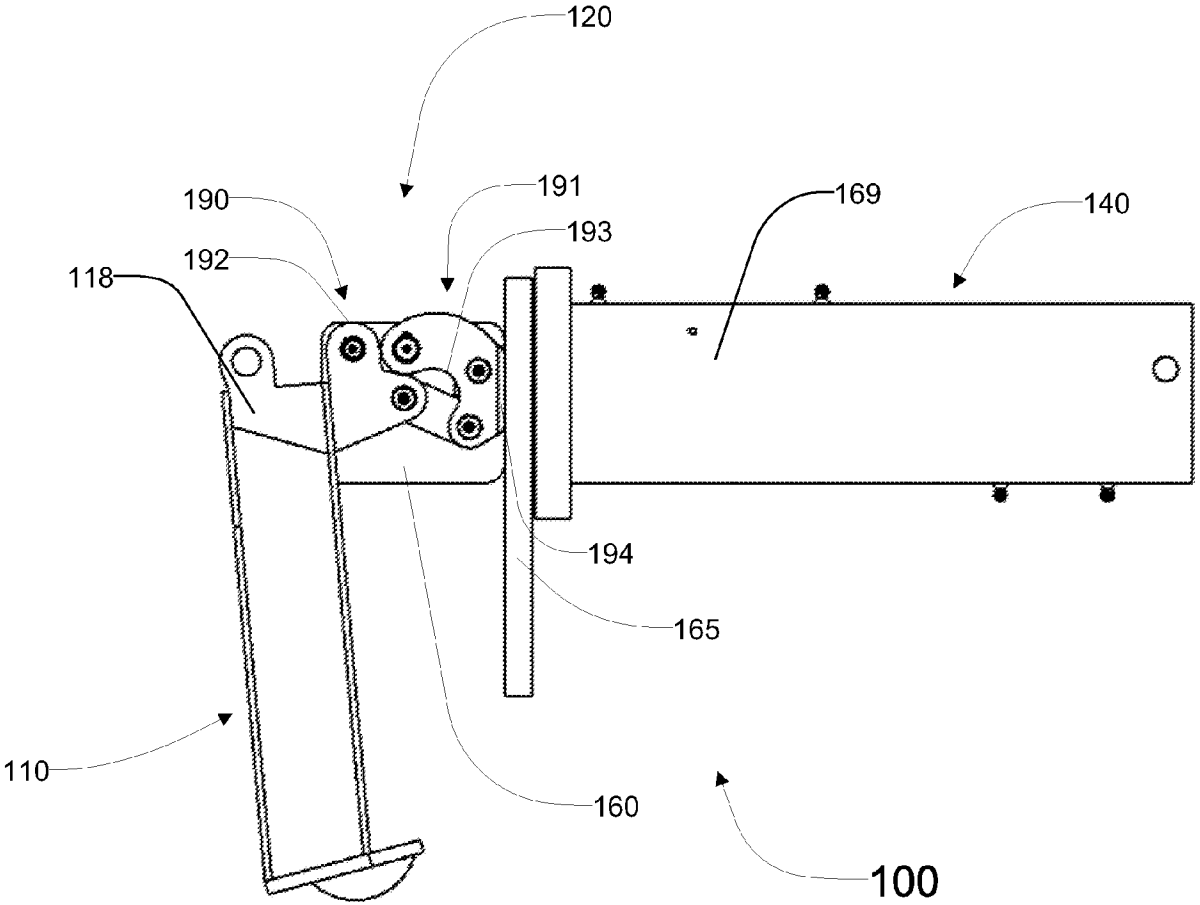
FIG. 4 is a side view of another embodiment of a linkage clamping system in a retracted position with the clamp rotated down.
Figure 5:
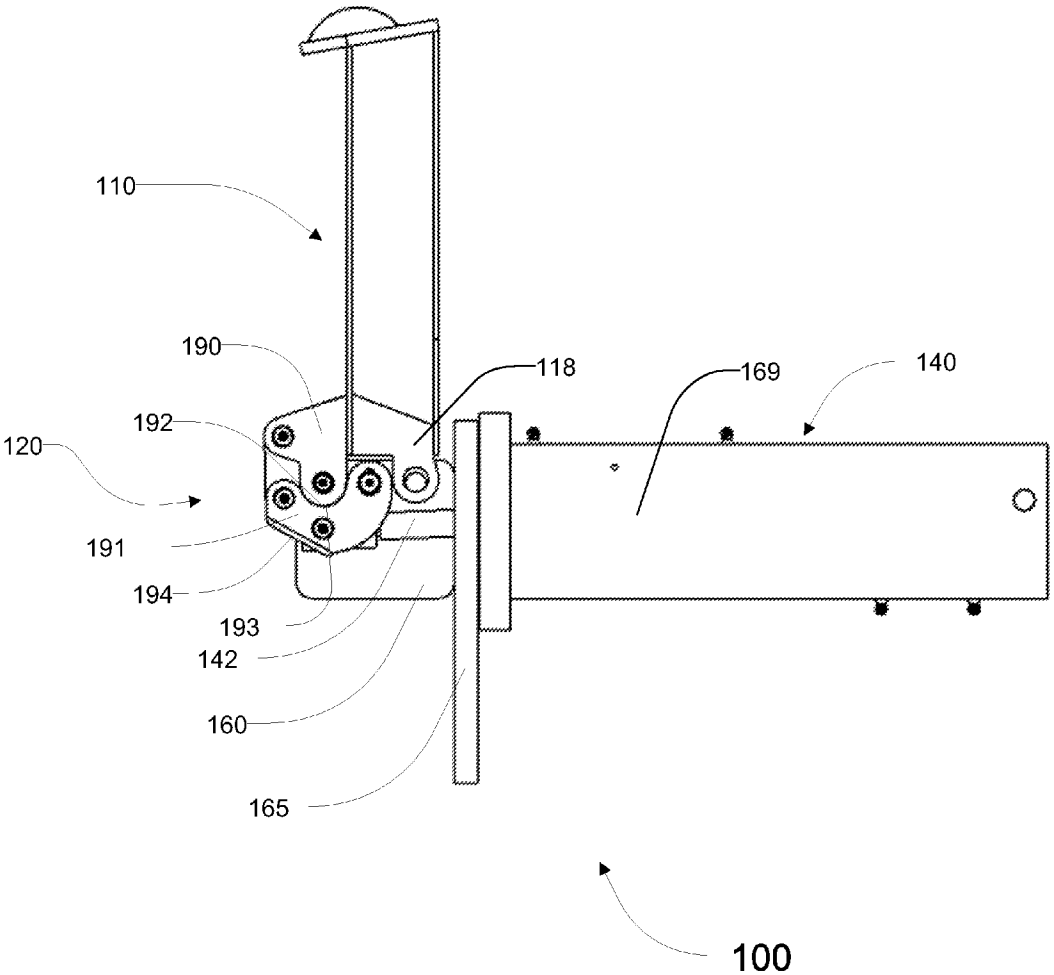
FIG. 5 is a side view of the embodiment of the linkage clamping system of FIG. 4 in a retracted position with the clamp rotated up.
Figure 6:
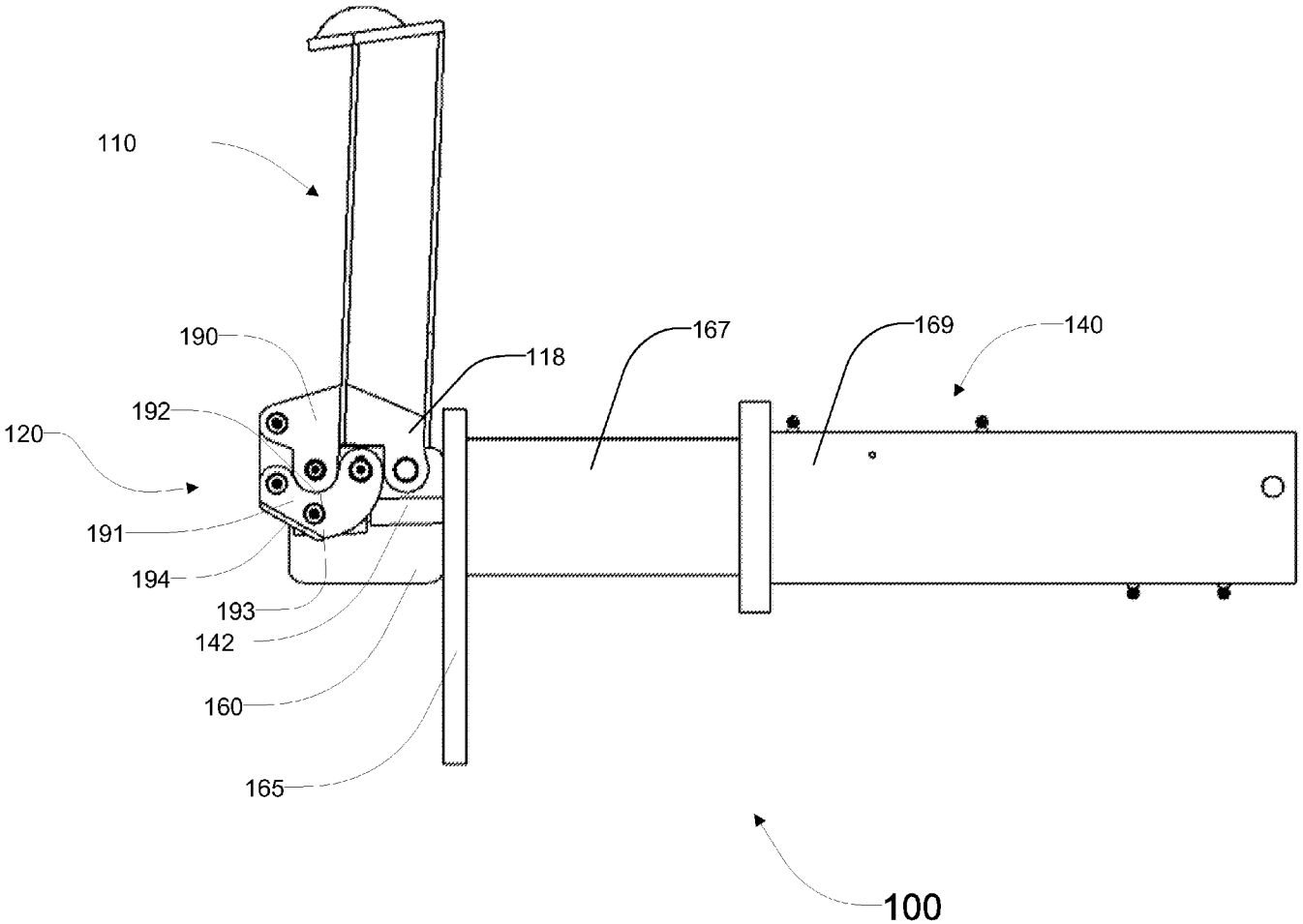
FIG. 6 is a side view of the embodiment of the linkage clamping system of FIG. 4 in an extended position with the clamp rotated up.
Figure 7:
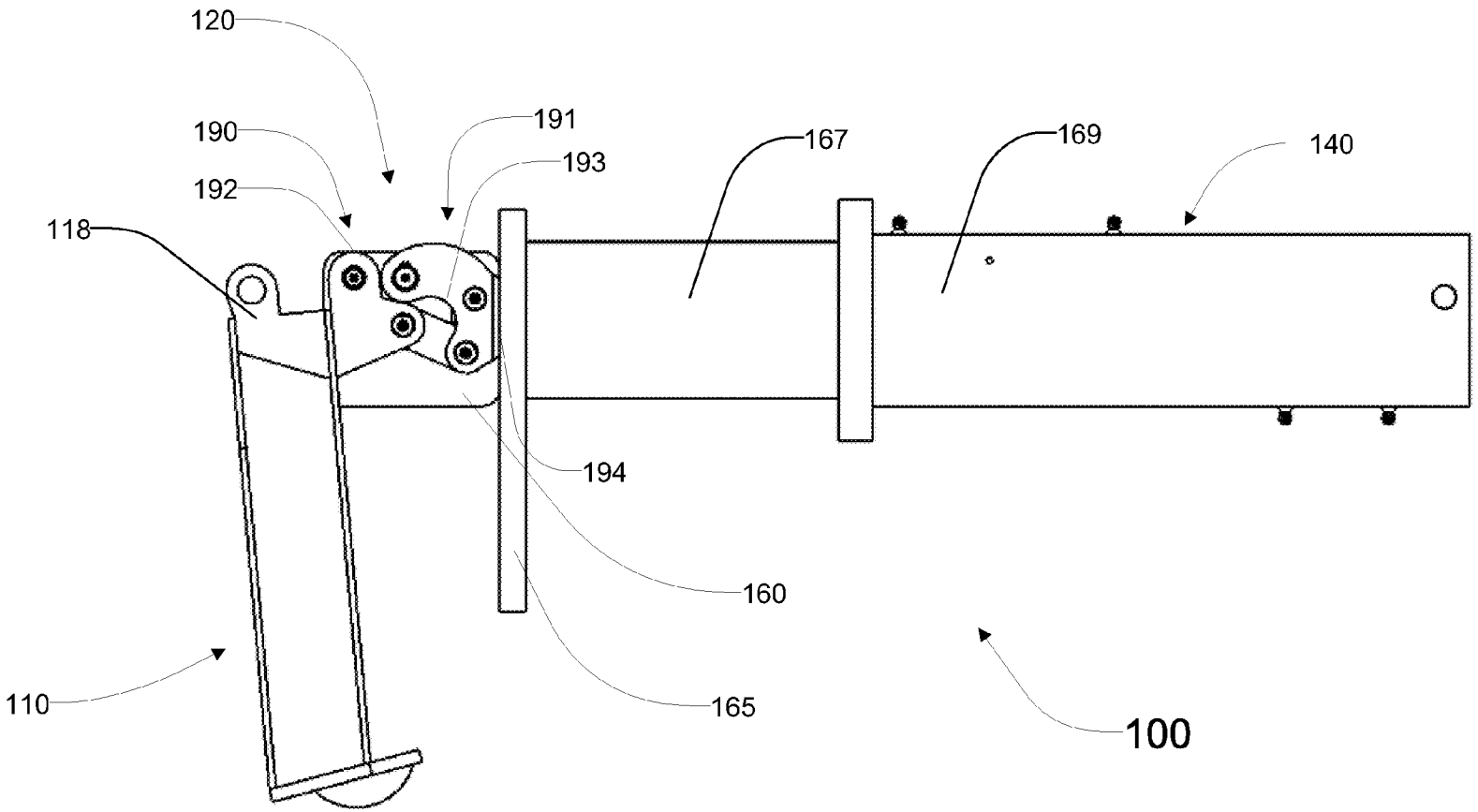
FIG. 7 is a side view of the embodiment of the linkage clamping system of FIG. 4 in an extended position with the clamp rotated down.

FIGS. 4 through 7 show an embodiment of a linkage clamping system 100 in four demonstrative states. As shown in FIG. 4, the linear actuator 140 of the linkage clamping system 100 is in a retracted state with the clamping member 110 rotated down. FIG. 5 shows the linkage clamping system 100 of FIG. 4 with the linear actuator 140 in a retracted state, but with the clamping member 110 rotated up. FIG. 6 shows the linkage clamping system 100 of FIG. 4 with the linear actuator 140 in an extended state; the clamping member 110 remains rotated up. FIG. 7 shows the linkage clamping system 100 of FIG. 4 with the linear actuator 140 in an extended state and with the clamping member 110 rotated down.

As illustrated by FIG. 4 through 7, the clamping member 110 may have a full rotation of about 180 degrees and may have a typical lateral movement of about 18 inches. However, the rotational linkage assembly 120 may be configured to enable less than or greater than 180 degree rotation, such as, for example, rotation of about 45 degrees or about 200 degrees. Opposition to rotation may be provided by physical stops or by one or more linkages that may bind to oppose rotation. The rotational linkage assembly 120 may be configured to provide, for example, about 90 degrees of rotation, or greater than about 90 degrees of rotation, or may be configured to provide greater than about 180 degrees.

Lateral movement of the clamping member 110 is limited only by the capability of the linear actuator 140, and may be any distance chosen between zero and the maximum shaft length limit of the linear actuator. Linear actuators 140 are manufactured in standard sizes with standard size extension lengths, such as, for example, 8 inch, 12 inch, 18 inch, 24 inch, 32 inch, 36 inch, or 48 inch, among other suitable standard sizes. Further, linear actuators 140 are also available in any length and may be ordered in increments of, for example about 1 inch.

Rotation of the clamping member 110 corresponds to an extension of the linear actuator 140. For example, the clamping member 110 may be rotated about 180 degrees with an extension of about 7 inches by the linear actuator 140. The linkage clamping system 100 may be scaled or have differently sized components that may change the extension required for rotation. For example, one or more linkages of the rotational linkage assembly 120 may be scaled to half size, which may allow the clamping member 110 to be rotated about 180 degrees with about 3.5 inches of extension by the linear actuator 140.

Referring again now to FIG. 4, an embodiment of a linkage clamping system 100 comprises a linear actuator 140, a rotational linkage assembly 120, and a clamping member 110. In this embodiment, the linear actuator 140 comprises a shaft 142 (shown in FIG. 5), a linkage mounting member 160 connected to a tubing plate 165, which is connected to a telescoping tubing 167 (shown in FIG. 6), which is slidably connected to a tubing body 169. The shaft 142 is slidably connected to the linear actuator body 144 (best shown in FIG. 2), which may be positioned within the tubing body 169. An opening (not shown) may be formed in the tubing plate 165 such that the shaft 142 may pass through, as shown in FIG. 5. In this embodiment, the rotational linkage assembly 120 comprises a clamp linkage set 190 and a actuator linkage set 191 which are rotatably connected to the linkage mounting member 160 with a mounting means, such as, for example, by one or more linkage through pins, such that the linkage sets 190, 191 may rotate about the mounting means. The clamp linkage set 190 comprises a mating surface 192. The actuator linkage set 191 comprises a corresponding mating surface 193 and a planar portion 194.

When in use, the linkage clamping system 100 may start from a state in which the clamping member 110 is retracted and rotated down, such as the state illustrated by FIG. 4. Actuation by the linear actuator 140, moving the shaft 142 out of the actuator body 144, first actuates the rotational linkage assembly 120. This actuation may rotate the clamping member 110 up a number of degrees until the mating surfaces 192, 193 of the linkage sets 190, 191 meet, binding and preventing further rotation, which effectively stops the actuation of the rotational linkage assembly 120, as illustrated by FIG. 5. Alternatively, the linkage clamping system 100 may comprise physical stops that may limit the rotation of at least one of the linkage sets 190, 191 of the rotational linkage assembly 120 or the clamping member 110.

With the actuation of the rotational linkage assembly 120 prevented, the resistance to further actuation of the rotational linkage assembly 120 is greater than the resistance to lateral movement by the shaft 142 and telescoping tubing 167. The linear actuator 140 may be further actuated in the same direction, which may move the clamping member 110 out to the full length of the extended shaft 142 and/or telescoping tubing 167, whichever is shorter, as illustrated by FIG. 6.

Figure 9:
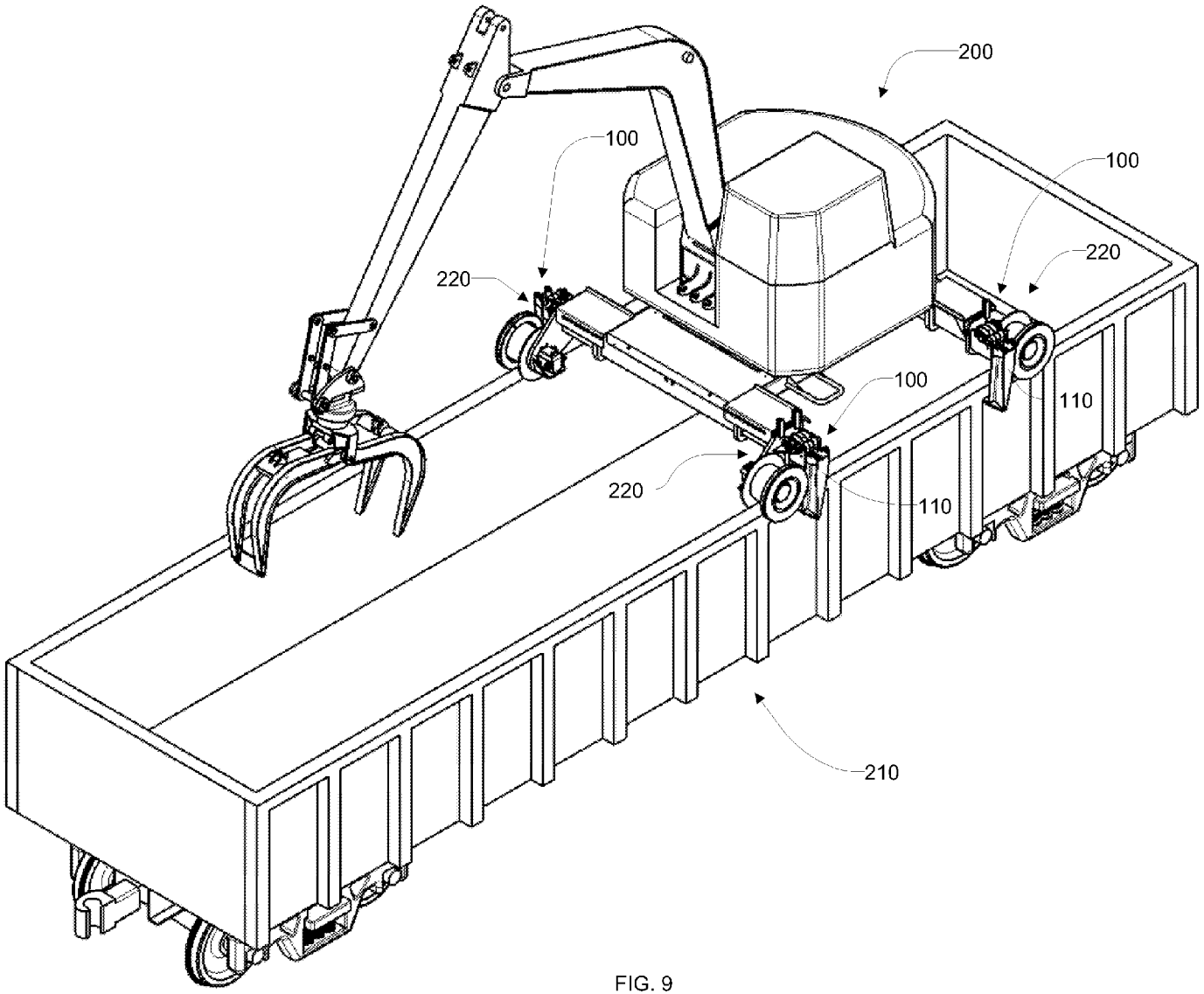
FIG. 9 is a perspective view of the material handler of FIG. 8 with the clamping members rotated down.

Actuation of the linear actuator 140 in the opposite direction produces a similar result. The rotational linkage assembly 120 is actuated and the mating surfaces 192, 193 of the linkage sets 190, 191 unbind, rotating the clamping member 110 down. If the downward rotation by the clamping member 110 does not result in a clamping connection, as shown in FIG. 9, the clamping member 110 will continue to rotate until the planar portion 194 of the actuator linkage set 191 meets the tubing plate 165, preventing further rotation, as illustrated by FIG. 7. Further retraction of the shaft 142 of the linear actuator 140 may result in lateral movement and retraction of the clamping member 110 until it is fully retracted, as illustrated by FIG. 4.

Alternatively, the downward rotation by the clamping member 110 may result in a clamping connection, connecting the linkage clamping system 100 to a piece of equipment, such as, for example, an open top railroad car 210 as shown in FIG. 9. This connection may provide a secure connection for a mobile apparatus, such as, for example, a material handler 200 (shown in FIG. 9), that includes an embodiment of the linkage clamping system 100. To release this connection, the linear actuator 140 may be actuated such that the shaft 142 is extended, rotating the clamping member 110 up. Pin up plates 118 (shown in FIGS. 4-7), may be used to secure the clamping member 110 to the linkage mounting member 160, for example, with pins, such that further rotation of the clamping member 100 is prevented.

As can be seen in the previous descriptions, a linkage clamping system 100 that actuates a rotational linkage assembly 120 (which may result in rotation of a clamping member 110), and laterally moves the clamping member 110 with a single linear actuator 140, has been disclosed. It would be appreciated by one of ordinary skill in the art that the configuration of the linkage clamping system 100 could be changed to rearrange the order in which the steps are achieved. For example, in the embodiment shown in FIGS. 1 and 2, the clamping member 110 rotates up when the shaft 142 is extended. The configuration of the linkage clamping system 100 could be changed such that the clamping member 110 rotates down when the shaft 142 is extended simply by configuring the clamping member 110 and rotational linkage assembly 120 upside down. Further, it is conceived that the ease of which each step is achieved could be changed, which may change the order of the steps. For example, the resistance to rotation and the resistance to lateral movement may be controlled or changed such that lateral movement may be achieved before the rotation of the clamping member 110. This may be accomplished through the use of mechanical stops, resistive elements, through actuated means, or through other suitable means, as would be apparent to one of ordinary skill in the art given the benefit of this disclosure.

Figure 8:
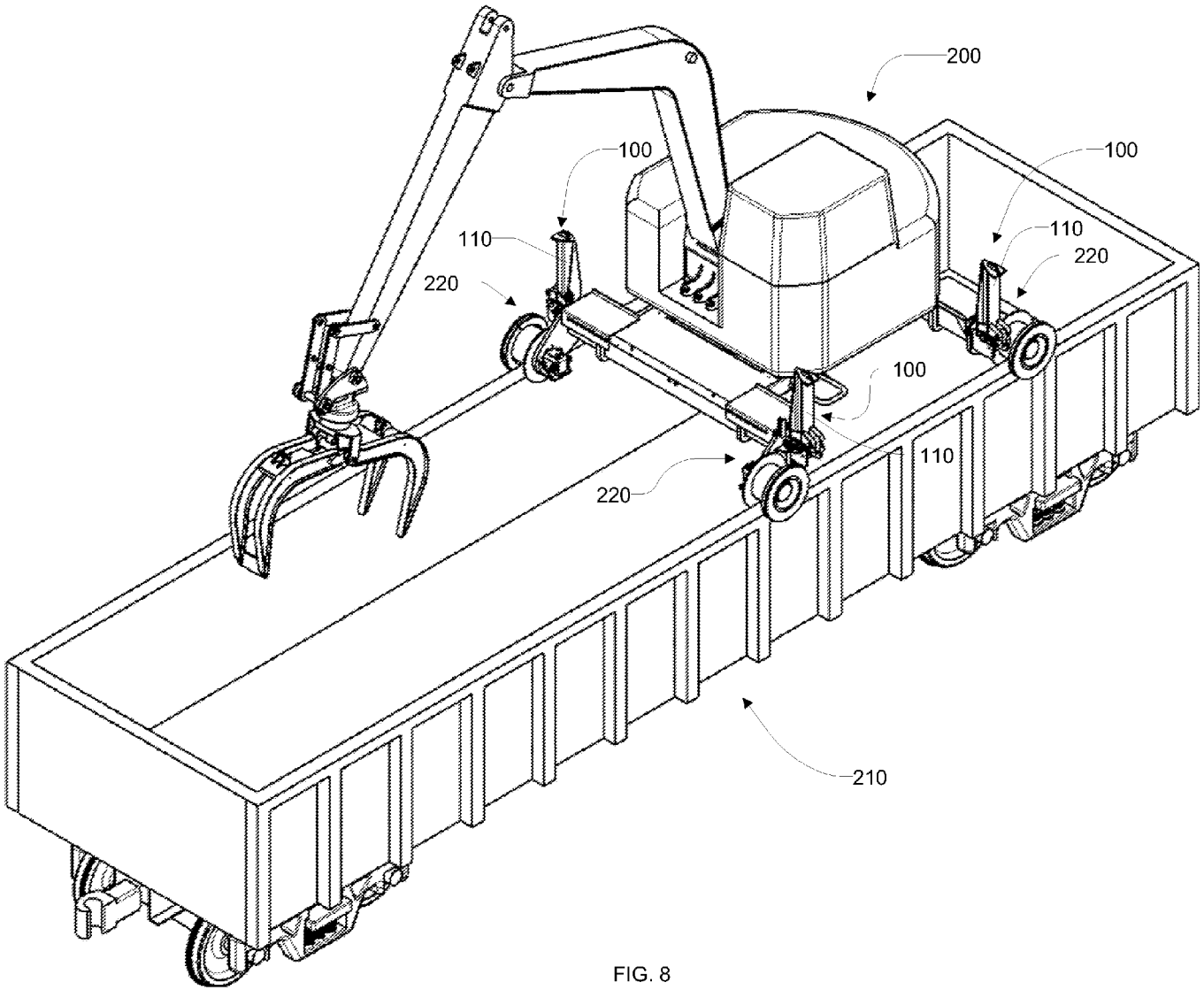
FIG. 8 is a perspective view of a material handler sitting on the sides of an open top railroad car, comprising an embodiment of a linkage clamping system, the clamping members rotated up.
Figure 10:
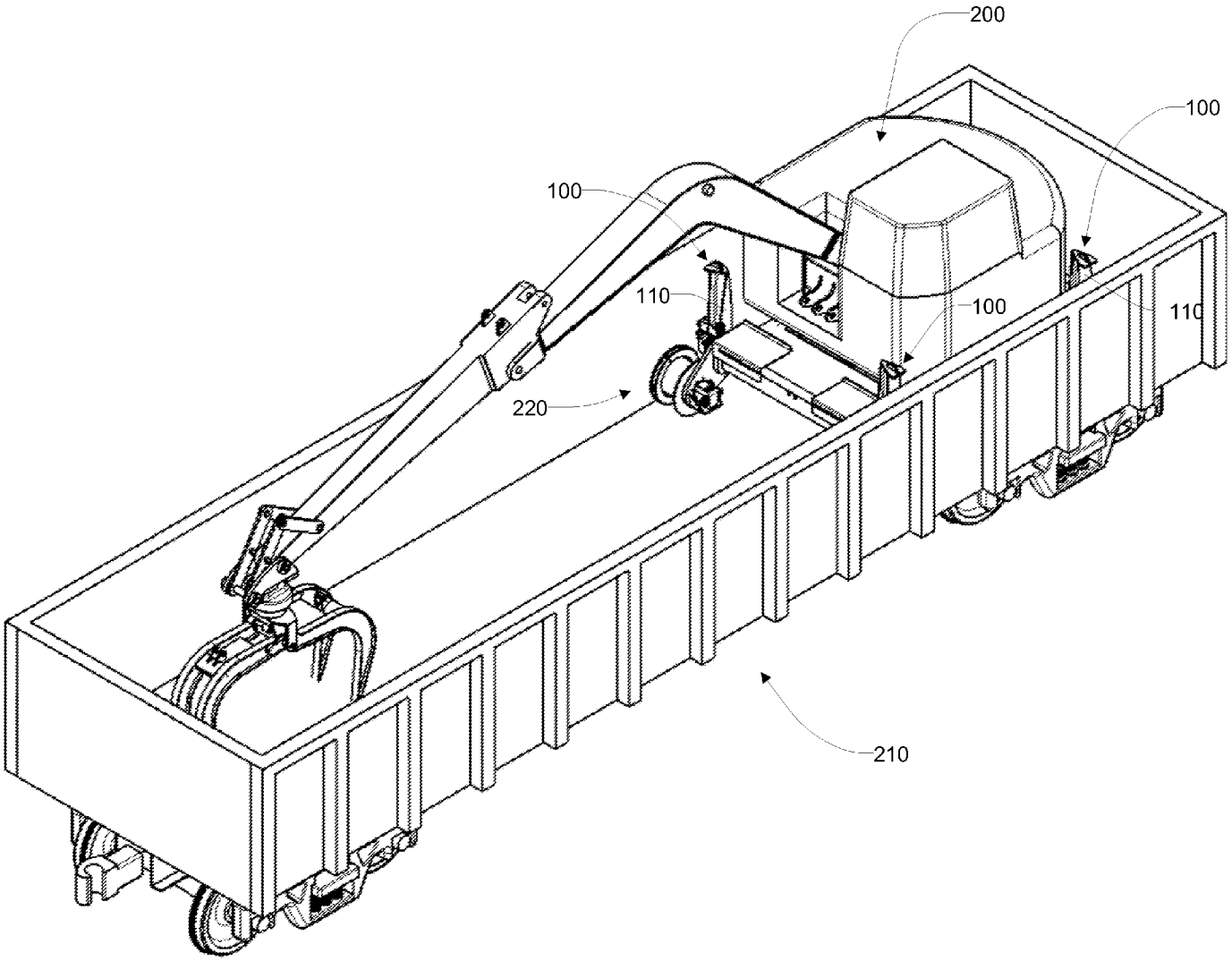
FIG. 10 is a perspective view of the material handler of FIG. 8, sitting on the floor of an open top railroad car with the clamping members rotated up.

FIGS. 8 through 10 show a material handler 200, that includes an embodiment of a linkage clamping assembly 100. The material handler 200 is shown atop an open top railroad car 210. The material handler 200 comprises a wheel assembly 220, which includes a linkage clamping assembly 100, which comprises a clamping member 110. As described in the incorporated U.S. patent application Ser. No. 11/472,952, the width between the wheel assemblies 220 of the material handler 200 may be varied to accommodate variable widths of material handler travelling surfaces (e.g. tracks, rails, railroad car sides, roads). Past embodiments of the material handler 200 have required two separate power units, such as, for example hydraulic pistons or electric motors. One power unit is used to move a wheel assembly laterally, while the other power unit is used to rotate the clamp. The linkage clamping assembly 100 disclosed herein may be used to both vary the lateral location of the wheel assembly 220 and to rotate the clamping member 110, with only a single power unit, the linear actuator 140.

FIG. 8 shows a material handler 200 resting on the sides of an open top railroad car 210, such as a gondola car. The material handler 200 comprises an embodiment of a linkage clamping assembly 100. As shown in FIG. 8, the clamping members 110 are rotated up; the material handler 200 of FIG. 8 is not secured to the open top railroad car 210. To secure the material handler 200 of FIG. 8 to the open top railroad car 210, the linkage clamping assembly 100 is actuated such that the clamping member 110 is rotated down to connect to the side of the open top railroad car 210, as shown in FIG. 9.

The secured material handler 200, as shown in FIG. 9, may be unsecured from the open top railroad car 210 by actuating the linkage clamping assembly 100 in the opposite direction such that the clamping member 110 is rotated up and away from the side of the open top railroad car 210, as shown in FIG. 8. Pin up plates 118 (shown in FIGS. 4-7) may be used to prevent further rotation of the clamping member 110. When rotation of the clamping member 110 is prevented, the wheel assembly 220 may be moved laterally by linkage clamping assembly 100 without the step of rotating the clamping member 110.

The wheel assemblies 220 of the material handler 200 may be retracted laterally, such that they no longer meet the sides of the open top railroad car 210. The material handler 200 may then rest on the floor of the open top railroad car 210, as shown in FIG. 10, which may allow the material handler 200 to be easily moved to a new location in the open top railroad car 210.

While this invention has been described in conjunction with the exemplary embodiments outlined above, it is evident that many alternatives, modifications, and variations will be apparent to those skilled in the art.

For example, equivalent elements may be substituted for those specifically shown and described, certain features may be used independently of other features, and the number and configuration of various vehicle components described above may be altered, all without departing from the spirit or scope of the invention as defined in the appended Claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A linkage clamping system comprising:

a clamping member;

a linear actuator capable of linear movement;

a rotational linkage assembly, a first portion of the rotational linkage assembly being connected to the clamping member and a second portion of the rotation linkage assembly being connected to the linear actuator, wherein the rotational linkage assembly is adapted such that rotational movement of a portion of the rotational linkage assembly rotates the clamping member and lateral movement of the rotational linkage assembly laterally moves the clamping member, the rotational linkage assembly comprises at least one clamp linkage connected to the clamping member, at least one actuator linkage rotatably connected to the linear actuator, and at least one connecting linkage rotatably connected to the at least one clamp linkage and rotatably connected to the at least one actuator linkage; and wherein linear movement of the linear actuator both rotates and laterally moves the rotational linkage assembly, the lateral movement and rotation being distinct movements.

2. The linkage clamping system of claim 1, wherein the linear movement of the linear actuator first rotates a portion of the rotational linkage assembly and then laterally moves the rotational linkage assembly.

3. The linkage clamping system of claim 1, wherein the linear movement of the linear actuator first laterally moves the rotational linkage assembly and then rotates a portion of the rotational linkage assembly.

4. The linkage clamping system of claim 1, wherein the rotational linkage assembly is configured to bind after a number of degrees of rotation in a first direction, stopping the rotation in the first direction, and wherein the rotational linkage assembly is configured to unbind if rotated in the direction opposite of the first direction.

5. The linkage clamping system of claim 1, wherein the clamping member is configured to connect the linkage clamping system to a portion of an open top rail car.

6. The linkage clamping system of claim 1, wherein the linkage clamping system is configured to allow the clamping member to rotate at least about 45 degrees.

7. The linkage clamping system of claim 1, wherein the linkage clamping system is configured to allow the clamping member to be moved laterally at least about 1 inch.

8. The linkage clamping system of claim 1, wherein the linkage clamping system is configured to be used with a material handler.

9. The linkage clamping system of claim 1, wherein the linear actuator comprises a hydraulic power unit, an electric power unit, or a pneumatic power unit.

10. The linkage clamping system of claim 1, wherein the rotational linkage assembly comprises a set of two clamp linkages connected to the clamping member, a set of two actuator linkages connected to the linear actuator, and a connecting linkage, the connecting linkage being rotatably connected to the set of two clamp linkages and rotatably connected to the set of two actuator linkages.

11. The linkage system of claim 10, wherein the linear actuator comprises an actuator connector connected to a shaft, the shaft being slidably connected to an actuator body, and wherein the second set of two linkages is rotatably connected to the linear actuator at the actuator connector.

12. The linkage clamping system of claim 1, further comprising a mounting plate, wherein at least one of the linkages is rotatably connected to the mounting plate.

13. The linkage clamping system of claim 1, further comprising a pinup plate connected to the clamping member, wherein the pinup plate is configured be able to prevent rotation of the clamping member.

14. A rotational linkage assembly comprising:

at least one clamp linkage, having a first mating surface, a portion of the clamp linkage being configured to be connected to a clamping member;

at least one actuator linkage, having a second mating surface that corresponds to the mating surface of the at least one clamp linkage, a portion of the actuator linkage being configured to be rotatably connected to a linear actuator;

a connecting linkage rotatably connected to the at least one actuator linkage and rotatably connected to the at least one clamp linkage; and at least one mounting plate, at least one linkage being rotatably connected to the at least one mounting plate, and wherein the first mating surface and the second mating surface are configured to meet and bind after the linkages are rotated a number of degrees in a first direction, and wherein the first mating surface and the second mating surface are configured to unbind if the linkages are rotated in a direction opposite of the first direction.

15. The rotational linkage assembly of claim 14, wherein the at least one actuator linkage comprises at least one planar portion, wherein the planar portion is configured to mate with a plate after the linkages are rotated a number of degrees in a second direction, opposing further rotation in the second direction.

16. The rotational linkage assembly of claim 14, wherein the clamp linkage is generally curved, the actuator linkage is generally L-shaped, and the connecting linkage is generally straight.

17. The rotational linkage assembly of claim 14, wherein the actuator linkage comprising a first end, a second end and a middle, the mating surface of the at least one clamp linkage being at an end of the at least one clamp linkage, and the mating surface of the at least one actuator linkage being at about the middle of the at least one actuator linkage.

18. The rotational linkage assembly of claim 14, wherein the rotational linkage assembly comprises two clamp linkages, with at least a portion of the clamp linkages being separated by a clamp linkage separator, two actuator linkages, with at least a portion of the actuator linkages being separated by an actuator linkage separator, and wherein the connecting linkage separates at least a portion of the clamp linkages and at least a portion of the actuator linkages.

19. A method for clamping comprising:

actuating a linear actuator to move linearly;

rotating a clamping member;

moving the clamping member laterally, wherein the rotation of the clamping member and the lateral movement of the clamping member are distinct motions, and wherein linear movement of the linear actuator rotates the clamping member and laterally moves the clamping member; and moving a wheel laterally simultaneously while moving the clamping member.

20. The method of claim 19, wherein rotating the clamping member is achieved through the actuation of a rotational linkage assembly by the linear actuator.

21. A mobile apparatus comprising:

a wheel mount connected to a mobile apparatus, the wheel mount comprising at least one wheel, the lateral distance from the wheel to the mobile apparatus being adjustable;

a linkage clamping system comprising a linear actuator connected to the wheel mount, a rotational linkage assembly connected to the linear actuator, and a clamping member connected to the rotational linkage assembly;

wherein the clamping member is configured to be moved laterally by the linear actuator and the clamping member is configured to be rotated with rotation of the rotational linkage assembly;

wherein rotation of the rotational linkage assembly is actuated by linear movement of the linear actuator; and wherein the lateral movement of the clamping member and the rotation of the clamping member are distinct motions.

22. The mobile apparatus of claim 21, wherein the lateral distance between the wheel and the mobile apparatus is configured to be adjusted by the linear actuator simultaneously with the lateral movement of the clamping member.

23. The mobile apparatus of claim 21, further comprising a plurality of linkage clamping systems.

24. The mobile apparatus of claim 21, wherein the clamping member is configured to secure at least a portion of the mobile apparatus to an open top railroad car.

25. The mobile apparatus of claim 21, wherein the rotational linkage assembly comprises a plurality of linkages.

26. The mobile apparatus of claim 25, wherein the plurality of linkages comprise at least one set of mating surfaces, the mating surfaces being configured to bind at a number of degrees of rotation, the binding limiting rotation of the clamping member in at least one direction, and wherein the mating surfaces are configured to unbind with rotation in the opposite direction.

27. A linkage clamping system comprising:

a clamping member;

a pinup plate connected to the clamping member, wherein the pinup plate is configured be able to prevent rotation of the clamping member;

a linear actuator capable of linear movement;

a rotational linkage assembly, a first portion of the rotational linkage assembly being connected to the clamping member and a second portion of the rotation linkage assembly being connected to the linear actuator, wherein the rotational linkage assembly is adapted such that rotational movement of a portion of the rotational linkage assembly rotates the clamping member and lateral movement of the rotational linkage assembly laterally moves the clamping member; and wherein linear movement of the linear actuator both rotates and laterally moves the rotational linkage assembly, the lateral movement and rotation being distinct movements.

* * * * *